US005947316A

United States Patent [19]

Guillonnet

[11] Patent Number: 5,947,316

[45] Date of Patent: Sep. 7, 1999

[54] DEVICE FOR OPENING AND CLOSING A PACKAGE, AND PACKAGE PROVIDED WITH SUCH A DEVICE

[75] Inventor: Michel Guillonnet, Lyons, France

[73] Assignee: International Paper Emballages Liquides SA - Ipel SA, France

[21] Appl. No.: 08/877,996

[22] Filed: Jun. 18, 1997

[30] Foreign Application Priority Data

Jul. 19, 1996 [FR] France ..... 96 09343

[51] Int. Cl.[6] ..... B65D 17/34; B65D 17/42; B65D 43/16

[52] U.S. Cl. ..... 220/269; 220/271; 220/277; 220/278; 220/337; 229/125.03; 229/125.08; 229/204; 229/238

[58] Field of Search ..... 220/269, 253, 220/254, 256, 258, 259, 260, 267, 263, 265, 266, 268, 270, 271, 274, 277, 278, 337; 229/200, 204, 211, 238, 125.01, 125.03, 125.08

[56] References Cited

U.S. PATENT DOCUMENTS

| | | | |
|---|---|---|---|
| 2,649,989 | 8/1953 | Urbano | 220/278 |
| 2,660,781 | 12/1953 | Harms | 220/278 |
| 4,915,290 | 4/1990 | Robichaud et al. | 220/269 |
| 4,930,683 | 6/1990 | Farber | 220/258 |
| 5,806,757 | 9/1998 | Per et al. | 220/269 |

FOREIGN PATENT DOCUMENTS

| | | |
|---|---|---|
| 0161754 | 11/1985 | European Pat. Off. . |
| 0658480 | 6/1995 | European Pat. Off. . |
| 90/14280 | 11/1990 | WIPO . |
| WO 92/00883 | 1/1992 | WIPO . |
| 92/18394 | 10/1992 | WIPO . |
| WO 95/33656 | 12/1995 | WIPO . |

*Primary Examiner*—Stephen Castellano
*Assistant Examiner*—Niki M. Eloshway
*Attorney, Agent, or Firm*—Parkhurst & Wendel, L.L.P.

[57] ABSTRACT

A package opening and closing device for a brick-type package is fastened thereon near an opening region defining a pouring region for the product contained in the package. The opening region is provided with prescoring to allow the package to be opened during the first use. The device includes a peripheral ring fastened to the package near the perimeter of the opening region, a lid to seal off the opening region reversibly and being fixed to the peripheral ring, and a lever hinged by a hinge pin in the horizontal plane containing the device to rupture the pouring region along the prescoring. The lever has a first part intended first of all, by the lever effect, to break some of the prescoring to allow effective opening of the package, and then to be held in place inside the package thus opened and a second part, constituting the lever arm acting on the first part, intended, after having acted cooperatively with the first part, to be folded back into its initial position to be parallel and in the plane containing the peripheral ring.

11 Claims, 5 Drawing Sheets

DEVICE FOR OPENING AND CLOSING A PACKAGE, AND PACKAGE PROVIDED WITH SUCH A DEVICE

The invention relates to a device intended to enable a package, particularly a package produced essentially from board, to be opened and closed and more particularly intended for brick-shaped packages.

It also relates to the packages provided with such a device.

Packages produced essentially from board for liquid products have been extensively developed in recent years and are particularly tailored to the preservation and storage of food products, such as, for example, milk, fruit juices, etc.

Packages of this type, which advantageously are brick-shaped, prove to be most particularly desirable whenever problems of transportation, storage and, as a corollary, stacking arise.

However, the problem, on the one hand, of opening them and, on the other hand, of the possibility of closing them after a first use arose a very long time ago. At the same time, although solutions have been made to these problems of successive opening and closing, the objective nevertheless remained, notwithstanding the presence of such an opening and closing system, to pursue the possibility of storing and stacking such packages. To this end, various opening and closing systems have been proposed.

A device has been described, for example in document EP-A-0,658,480, for opening and closing a brick-type package made of board, the device being positioned near a hole made beforehand in the upper face of the said package. This hole is sealed off before the first use by means of a welded or heat-sealed film. The opening device proper consists of two basic parts, namely a peripheral ring, which is attached to the package around the hole and is intended to help the pouring of the liquid contained in the package, and a lid, which is hinged at one of the ends of the said ring and is intended to act cooperatively with the latter in a sealed manner so as to allow successive opening and closing operations, to which lid the end of the sealing film is fastened in such a way that opening the lid, during the first time the package is used, i.e. when it is opened for the first time, pulls on the sealing film, unsealing it from the perimeter of the hole and hence allowing the actual opening of the package. Moreover, taking into account the dimensions of this opening and closing system, it remains possible to stack the packages.

However, fitting such an opening device assumes two successive operations, namely, first of all, fitting the sealing film and then fitting the opening device proper. As a result, apart from an adverse effect on the production rates arising from fitting such a system, this also entails an additional cost, to the detriment of profitability.

In order to overcome drawbacks caused by fitting an opening device in two steps, another opening and closing system has also been proposed, for example in document WO 92/18394, still for packages, particularly brick-type packages, which comprises a base or ring defining a hole, the said hole being opposite that upper region of the package which is provided for allowing the liquid which it contains to be poured out, and which is provided for this purpose with prescoring. It also comprises a lid, hinged to one of the ends of the said ring and intended to act cooperatively with the latter so as to be fluidtight, at the very least with respect to the liquid. Finally, it comprises a pusher element which is hinged to the same end of the ring as the lid and, before any use of the package, is welded at welding spots to the said ring near its other end. This pressing element is provided with an internal projection intended, under the action of a force exerted by the user's finger, to tear the prescored regions in such a way as to produce a hole in the package and hence release, when required, the flow of liquid.

In other words, the first opening of the package consists, once the lid has been opened, in pressing on this pusher element in such a way as to open the package proper, the following opening and closing operations simply being performed by opening and closing the lid, the pusher element then remaining permanently inside the package.

Although this opening and closing device also makes it possible, because of its small size, to store and stack the corresponding packages, the user, however, during the first opening operation, gets his finger wet when he presses on the pusher element. Moreover, given the force to be exerted in order to overcome the resistance of the prescored regions made vertically below the pusher element, it is not unusual to see splashes of the liquid. In other words, this system is not hygienic.

An opening and closing system, still for packages made of board, particularly brick-shaped packages, has also be proposed, for example in document wo 90/14280, which includes a lever hinged at one of the ends of the ring. This lever consists of two parts, namely an internal part, intended to pivot inside the package, and an external part, intended to allow pivoting of the internal part, precisely by a lever action with respect to the hinge pin of the lever. The said lever is actuated by means of the lid during the first use, in such a way as to rupture the weaker or prescored regions in order to allow access to the inside of the package. In this example, the lid intended to allow successive opening and closing of the package is in the open position before the first use.

In other words, the action of the pusher element of the above document is replaced by the lever, so that there is no longer the risk of the user's finger getting wet, but, however, the risk of splashing still remains.

Moreover, in these various configurations, the liquid pours out relatively irregularly and causes splashes, given the ingress of air into the package in order to occupy the volume liberated by the liquid.

The object of the invention is to overcome these various drawbacks. It provides an opening and closing device for packages, particularly packages essentially made of board and more particularly brickshaped packages, which is simple to employ, at a low manufacturing cost and is easy to fit.

This device for opening and closing a package, particularly a brick-type package, is intended to be fastened to the said package near an opening region which incorporates a pouring region for the product contained in the package, the said opening region being provided with prescoring intended to allow the said package to be opened during the first use. It comprises:

- a peripheral element or ring, fastened to the package near the perimeter of the opening region;
- a lid, intended by acting cooperatively with the peripheral element or ring to seal off the said opening region reversibly, the said lid being fixed to said peripheral element; and
- a lever, hinged in a horizontal plane containing the device and intended, when it is actuated, to rupture the opening region at the prescoring, the hinge pin of the said lever lying opposite the opening region.

The invention is characterized in that the lever consists of two parts, lying on each side of the said pin:

- a first part, intended by the lever effect to break some of the prescoring which defines the pouring region, so as to allow effective opening of the package, and then to be held in place inside the package thus opened; and a second part, constituting the lever arm which acts on the said first part, intended, after having acted cooperatively with the first part, to be folded back into its initial position, i.e. so as to be parallel and in the plane containing the peripheral ring.

In other words, the invention consists in fitting in the opening region of a package, particularly a brick-type package, an opening system making use of a lever to break the prescored regions made beforehand, in such a way as to release a pouring region without any risk of splashing or of wetting the user's finger.

According to the invention, the said first part is connected to the hinge pin by means of a flexible tab; the rear end of the said part acts cooperatively with the front face of the said second part so as to constitute a lever.

Advantageously, the first part is provided with a central projection directed towards the opening region, the said projection being slightly tapered so as to make it easier to rupture the prescoring which defines the pouring region.

In another embodiment, this projection is replaced by a tip which extends the front end of the said first part, for the purpose of fulfilling the same function.

According to one embodiment of the invention, the peripheral ring includes, near the pouring region, lugs directed towards the inside of the ring and intended to act cooperatively with the rear face of the first part so as, after perforation of the prescoring, to hold this first part in place approximately perpendicular to the plane of the opening region, in order thereby not to interfere with the liquid as it pours out.

According to one particular embodiment of the invention, the said second part is also intended, after having been folded back, to pierce a prescored hole which itself is intended to act as a vent, also made near the opening region.

According to this embodiment, the said second part is provided with a projection pierced by an elongate through-hole, made so as to be approximately orthogonal to the plane of the said part, and is intended to pierce the prescored hole which is intended to form the vent.

Advantageously, the said projection has, near its lower end, an annular shoulder or projection intended to act cooperatively with the edges of the hole thus produced, in order to hold the said second part in a position such that it does not subsequently affect the opening and closing of the lid on the ring.

The invention also relates to the packages, particularly packages made of board, provided with such opening and closing devices.

The manner in which the invention may be realised and the advantages which stem therefrom will become clearer from the following illustrative embodiments given by way of non-limiting indication and supported by the appended figures.

FIG. 10 is a diagrammatic representation, seen from above, of the device according to a second embodiment of the invention, of which

Figure 1:
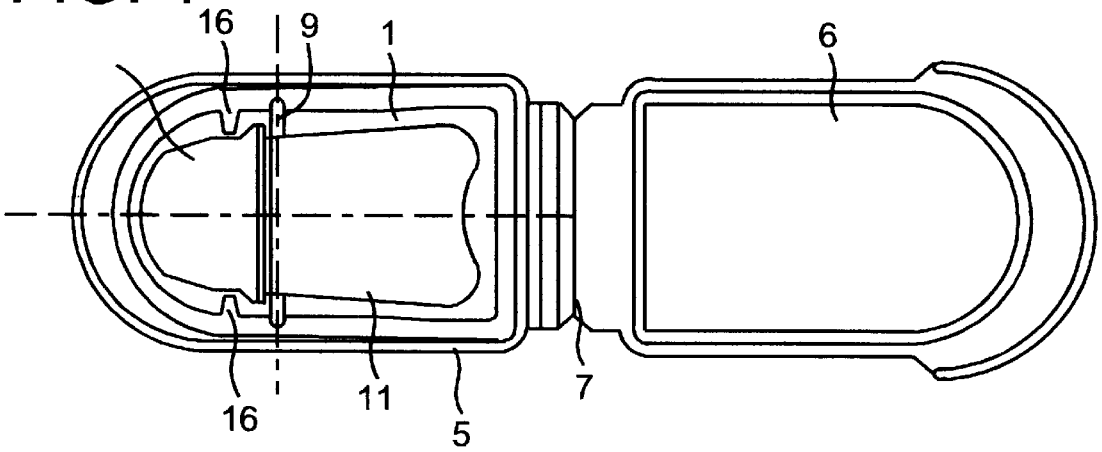
FIG. 1 is a diagrammatic representation, seen from above, of a first embodiment of the invention.
Figure 2:
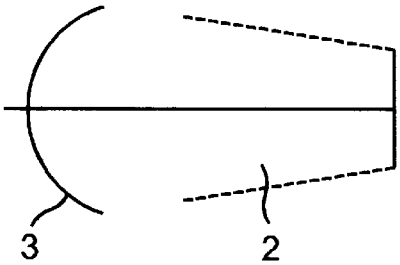
FIG. 2 is a representation, in plan view, of the prescored regions of the opening region according to the invention.
Figure 3:
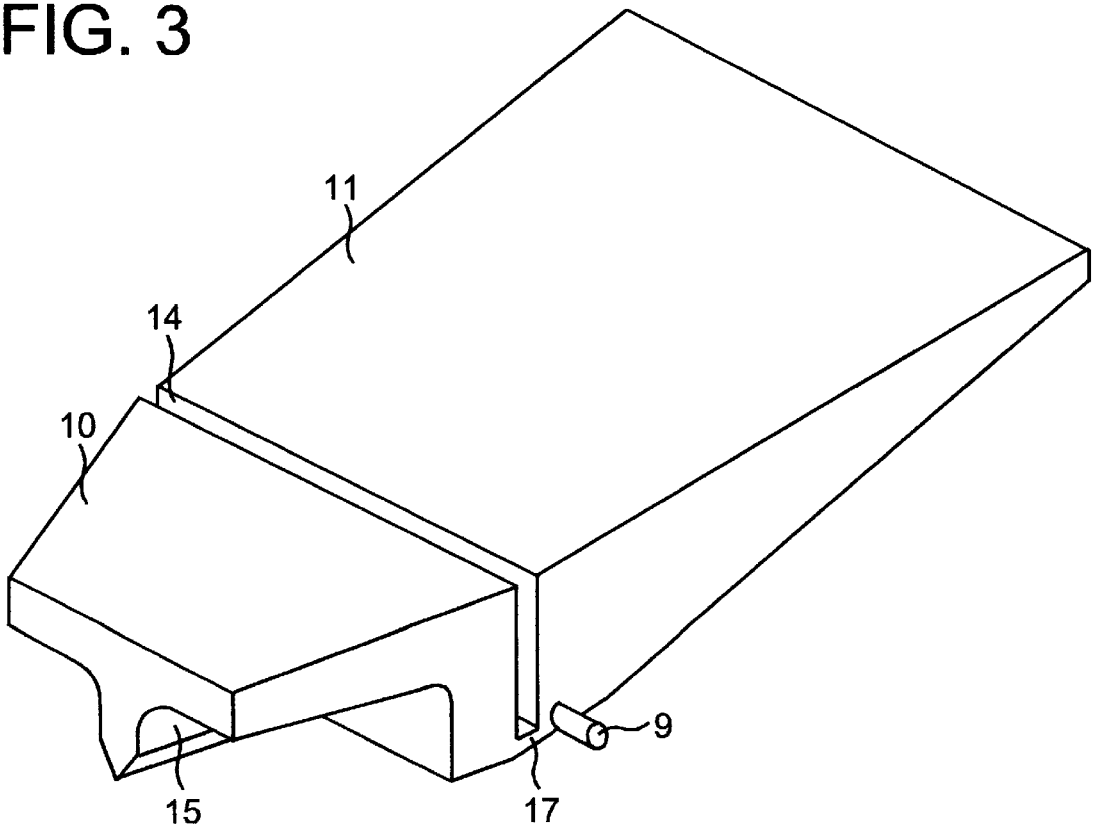
FIG. 3 is a diagrammatic representation, in perspective, of the lever according to the first embodiment.
Figure 4:
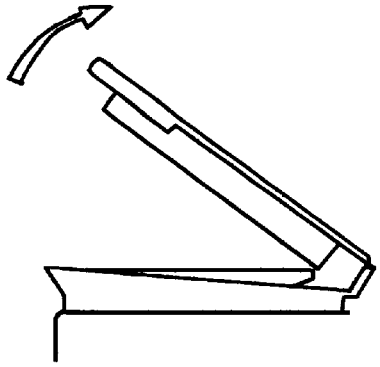
FIGS. 4 to 9 are diagrammatic views representing the way in which the device according to the invention is operated.
Figure 5:
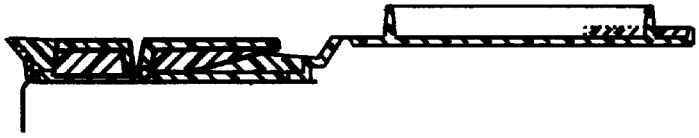
Figure 6:
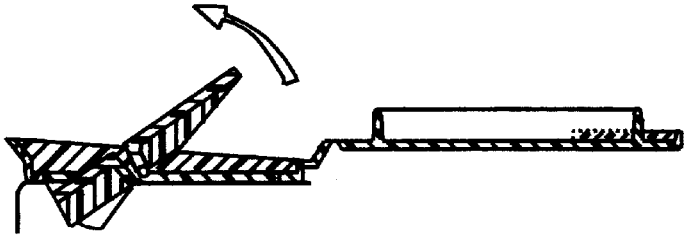

FIG. 1 therefore shows a diagrammatic view of the top of the opening and closing device according to the invention.

This opening and closing device is intended to be fitted onto a package which is essentially made of board, optionally aseptic, well-known per se, particularly brick-shaped and intended to contain a liquid, such as, for example, milk, fruit juice, etc.

On its upper face, this package includes an opening region (1) to which is fastened the opening and closing device according to the invention.

This opening region (1) in fact consists of a pouring region (2), bounded by prescoring (3) produced, for example, using laser technology.

The opening and closing device according to the invention basically comprises three elements.

The first element consists of a peripheral element or ring (5) fastened, particularly by bonding, to the upper face of the package around the opening region (1).

The second element consists of a lid (6) hinged to the end of the ring (5) at a hinge (7), as may be clearly seen in FIG. 1. The lid is capable of acting cooperatively with the ring (5) so as to provide a closure which is fluidtight, at the very least with respect to the liquid or product contained in the package.

The third element consists of a lever (8) hinged to the ring (5), opposite the opening region (1), by means of a hinge pin (9).

This lever consists of two parts, namely:

a front first part (10), intended to enter the package, after having broken the prescoring (3) which delimits the pouring region (2); and a rear second part (11), substantially independent of the first part (10), intended first of all to pivot towards the outside of the package while acting cooperatively with the said first part, so as to cause the lever effect resulting in rupture of the prescored regions (3) defining the pouring region (2), and then in turn to be folded back, in the rear part of the opening region (1), into the plane defined by the peripheral ring (5).

Figure 13:
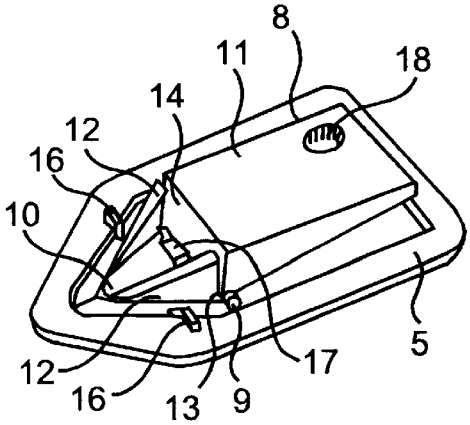
FIG. 13 is a diagrammatic representation, in perspective, of a similar embodiment of the lever according to the invention.
Figure 16:
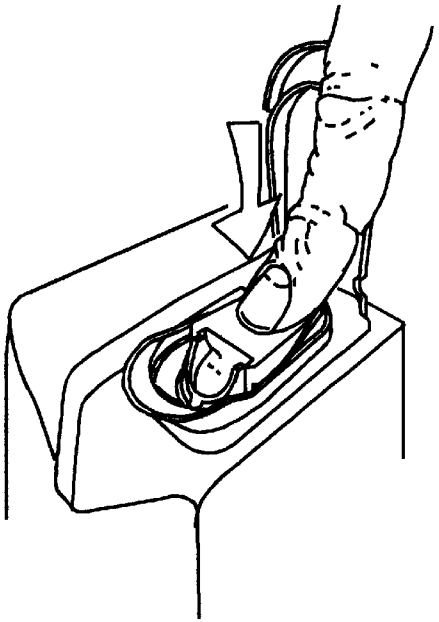
FIGS. 14 to 16 are diagrammatic representations, in perspective, of the way in which the device according to the invention is operated.
Figure 15:
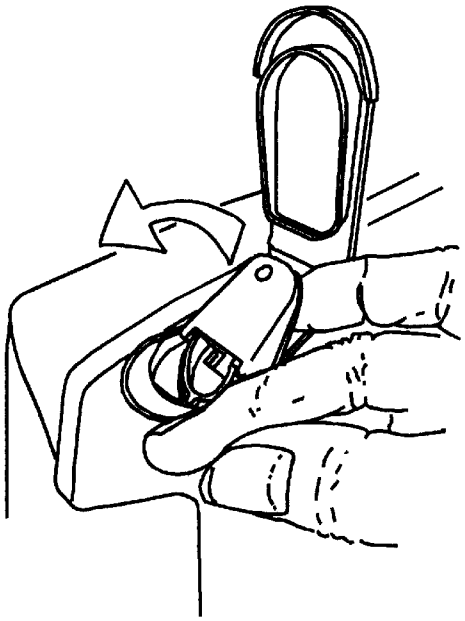
Figure 14:
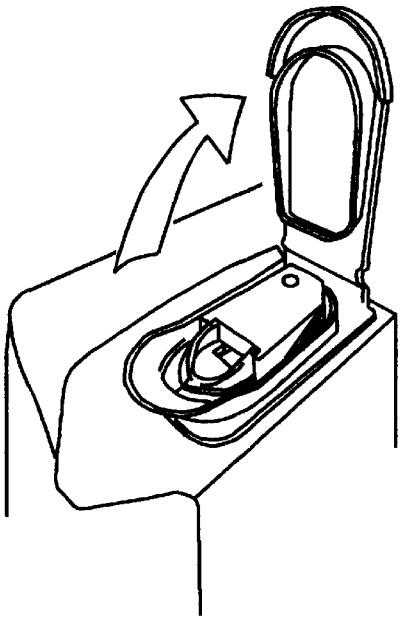
Figure 17:
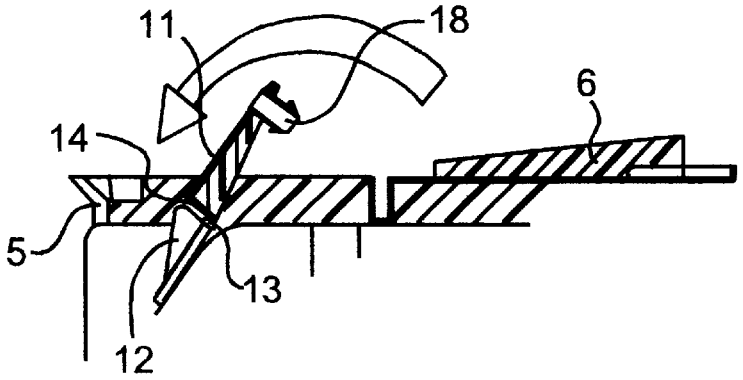
FIGS. 17 to 20 are diagrammatic representations, in cross-section, illustrating the operation of the device according to the invention.
Figure 18:
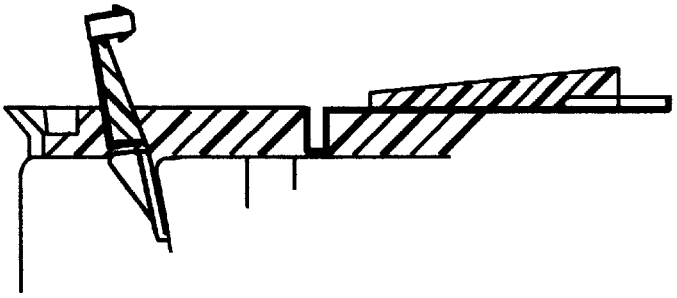
Figure 19:
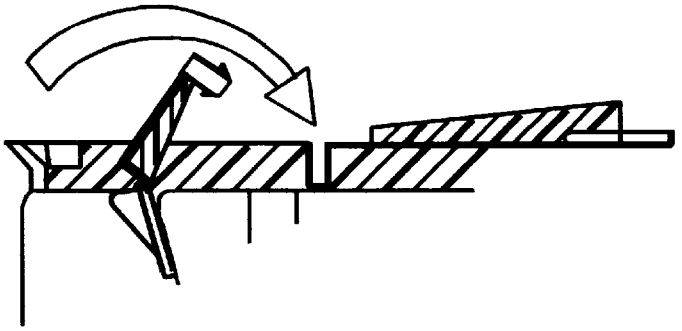
Figure 20:
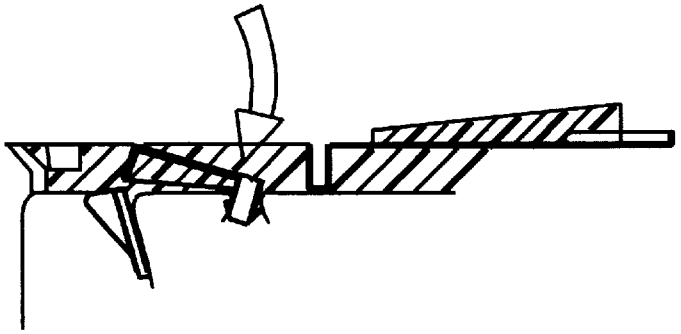

The first part (10), of substantially semicircular, triangular or trapezoidal shape, is connected to the hinge pin (9) by means of a flexible tab (17) and may have two side ribs (12) whose height increases from its end to the point where it acts cooperatively with the said second part (11) (FIG. 13). The end (13) of the said ribs (12), in other words the rear face of the said first part, is intended to act cooperatively with the front face (14) of the second part (11) during the phase of opening the pouring region.

In order to facilitate this opening phase, the front end of the first part (10) includes a pointed projection (15), advantageously moulded, intended to be pressed against the prescoring (3).

In the embodiment described in conjunction with FIGS. 1 to 9, this projection (15) is in the form of a central projection directed towards the opening region, the said projection being slightly tapered so as to make it easier to rupture the prescoring which defines the pouring region.

Thus, whenever pressure is exerted by the tip or projection (15) on this prescoring, constituting a weaker region, this results in the pouring region (2) being torn, as may be seen in FIGS. 6 to 9.

Figure 7:
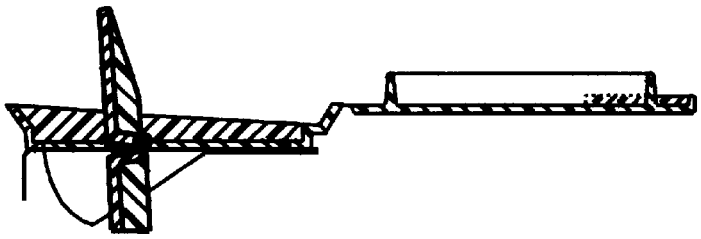
Figure 8:
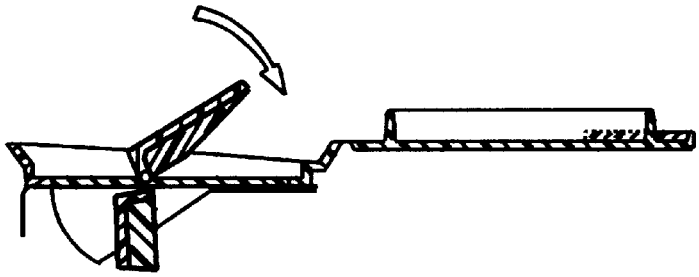
Figure 9:
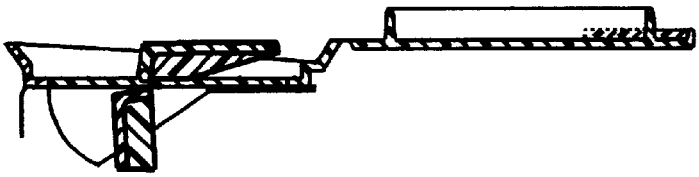
Figure 10:
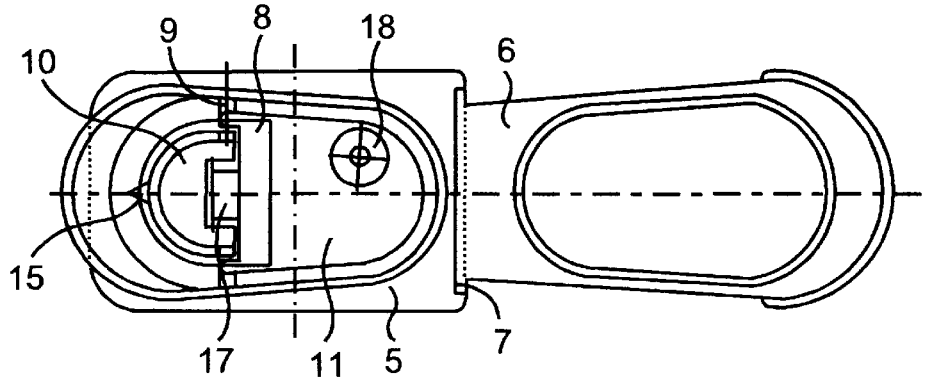
Figure 11:
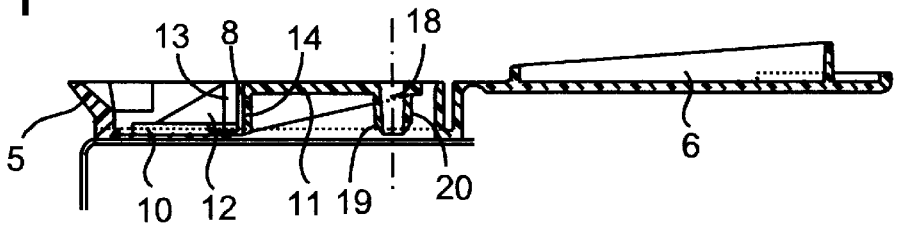
FIG. 11 is a view in longitudinal section.
Figure 12:
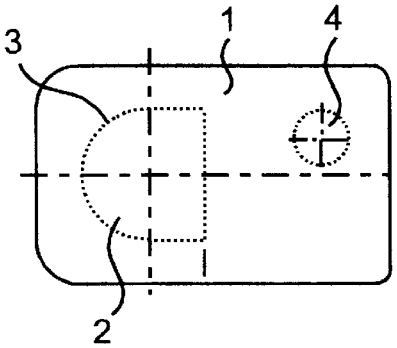
FIG. 12 is a representation, in plan view, of the prescored regions of the opening region according to this second embodiment.

In this embodiment, and as may be seen in FIGS. 7 to 9, if the board of which the package is made is rigid enough, the opening initiator produced by the central projection (15) results in the opening region being almost completely opened, thereby subsequently helping the liquid pour out.

In order for this first part (10) not to interfere with the flow of the liquid out of the package, the action of the lever, formed by the second part (11), is continued until the said first part becomes blocked by those portions of the opening region which have thus been cut and which bear against the ends (13) of the ribs (12) or the rear face of the said first part.

Advantageously, the peripheral ring (5) may also be provided with lugs (16) directed towards the inside (See FIGS. 1, 13) in such a way that they act cooperatively with the ends (13) of the ribs (12) or the rear face of the first part.

As already mentioned, the second part (11) fulfils the function of a lever arm, which acts cooperatively with the first part (10) in order to bring about the opening of the pouring region (2).

It is hinged at its front end to the hinge pin (9).

According to an embodiment shown in conjunction with FIGS. 10 to 20, the opening region (1) also includes another region (4) bounded by prescoring and, in the example described (see FIG. 12), circular in shape.

This region (4) is intended to form a vent after being pierced by the device according to the invention.

According to this embodiment, the second part (11) includes a projection (18) directed downwards, extending so as to be approximately perpendicular to its main face and intended to rupture the region (4) so as to form a vent. For this purpose, the projection (18) is pierced over its entire height by an elongate hole, thus forming a duct funnel, in order to allow communication between the outside and the inside of the package.

The lower end (19) of the projection (18) is slightly tapered so as to help to rupture the region (4). However, this end is extended by a much wider region (20), constituting an annular shoulder or projection intended to act cooperatively with the region thus opened, in such a way as to prevent the second part from moving back up in a forward direction, this being done so as not to interfere with the opening and closing of the lid (6) on the ring (5).

Advantageously, the whole assembly consisting of the ring (5) and the lever (8), including the two parts (10) and (11), is moulded and therefore constitutes a one-piece component.

The very simplicity of use and of operation of this device may therefore be imagined, since the risks of spraying or splashing are limited to the so-called pouring region. Moreover, the presence of the vent (4) makes it easier for the liquid to flow out of the package without the risk of splashing.

The various steps in the method of operating the device according to the two embodiments of the invention have been shown, on the one hand, in FIGS. 4 to 9 and, on the other hand, FIGS. 14 to 20.

This opening and closing device therefore proves to be particularly advantageous within the framework of the aseptic preservation of the contents of the package for which it is intended. Moreover, because of its simplicity of implementation and the construction of the components of which it is composed, in particular moulded plastic components, it has a low cost. Finally, because of its one-piece character, the fitting rates, and consequently the manufacturing cost of the final package may be optimized.

I claim:

1. In a device for opening and closing a package, particularly a brick-type package, the device being fastened to the package near an opening region which incorporates a pouring region for the product contained in the package, the opening region of the package being provided with a prescoring to allow the package to be opened easily during an initial usage, wherein the improvement comprises:

a peripheral ring attached to the package near the perimeter of the opening region;

a lid hinged to said peripheral ring and fitted to seal off the opening region reversibly;

a lever having a hinge pin opposite to the opening region and in a horizontal plane of the device permitting the lever to rupture the pouring region at the prescoring;

said lever comprising a first part to break at least a portion of the prescoring which defines the pouring region, said first part being located inside the package after an initial opening, and a second part comprising a lever arm that acts on said first part, said second part is folded back into an initial position parallel to and in the plane of said peripheral ring.

2. A device for opening and closing a package according to claim 1, wherein said first part is connected to the hinge pin by means of a flexible tab.

3. A device for opening and closing a package according to claim 1, wherein said first part includes side ribs, and a rear end which cooperates with a front face of said second part, so as to form a lever.

4. A device for opening and closing a package according to claim 1, wherein said first part has a rear face which cooperates with a front face of said second part, so as to constitute a lever.

5. A device for opening and closing a package according to claim 1, wherein a front end of said first part includes a tip on a lower end to facilitate a rupture of the prescoring in the pouring region.

6. A device for opening and closing a package according to claim 1, wherein said first part is provided with a central projection directed towards the opening region, said projection being slightly tapered to facilitate a rupture of the prescoring which defines the pouring region.

7. A device for opening and closing a package according to claim 1, wherein said peripheral ring, includes, near the pouring region, lugs directed towards an interior portion of said peripheral ring that cooperate with a rear end of a Pair of side ribs of said first part, or with a rear face of said first part, so as, after perforation of the prescoring to hold said first part in place so as to be approximately perpendicular to the plane of the opening region, to prevent interference with the liquid as it pours out of the package.

8. A device for opening and closing a package according to claim 1, wherein said second part is provided with a projection pierced by an elongate through-hole made approximately orthogonal to the plane of said second part, said projection piercing a prescored hole, to form a vent hole near the opening region.

9. A device for opening and closing a package according to claim 8, wherein said projection has, near its lower end, an annular shoulder circumferentially surrounding the vent hole produced in order to hold said second part in a position that does not interfere with the opening and closing of the lid on the peripheral ring.

10. A package for liquid capable of being closed again after an initial opening produced in the form of a parallelepiped board, an upper face of which includes an opening region provided with prescoring, comprising:

a peripheral ring fastened to the package near a perimeter of the opening region;

a lid fitted with said peripheral ring to seal off the said opening region reversibly, said lid being hinged to said peripheral element;

a lever, having a hinge pin in a horizontal plane of the device, and opposite to the opening region, said lever is actuable to rupture a pouring region at said prescoring, and said lever bounded on each side of said hinge pin, said lever comprising:

a first part, to break at least a portion of the prescoring which defines the pouring region, said first part being held in place inside the package after an initial opening;

a second part, after having cooperated with said first part, being foldable back into the initial position parallel to and in a plane defined by said peripheral ring.

11. A package according to claim 10, wherein:

said second part is provided with a projection pieced by an elongate through-hole made approximately orthogonal to the plane of said second part to form a vent hole near the opening region; and said projection has near a lower end, an annular shoulder circumferentially surrounding the vent hole to hold said second part in a position that does not subsequently interfere with the opening and closing of the lid on said peripheral ring.

* * * * *